US005392477A

United States Patent [19]

Wolter et al.

[11] Patent Number: 5,392,477

[45] Date of Patent: Feb. 28, 1995

[54] SLEEPING BAG WITH INFLATABLE WEDGE PORTION

[76] Inventors: Jon Wolter, 857-1/2 Bronson Rd., Fairfield, Conn. 06430; Patricia Cook, 41 Burr Farm Rd., Westport, Conn. 06880

[21] Appl. No.: 171,704

[22] Filed: Dec. 22, 1993

[51] Int. Cl.[6] ..... A47G 9/08

[52] U.S. Cl. ..... 5/413; 5/419; 5/420

[58] Field of Search ..... 5/417–420, 5/413, 634; 2/69.5

[56] References Cited

U.S. PATENT DOCUMENTS

| | | | |
|---|---|---|---|
| 1,222,563 | 4/1917 | Rosenberg | 5/419 |
| 1,324,009 | 12/1919 | Hope | 5/413 |
| 4,575,884 | 3/1986 | Jameson et al. | 5/413 |
| 4,601,076 | 7/1986 | Knobeloch | 5/413 |
| 5,072,467 | 12/1991 | Hunt | 5/419 |

FOREIGN PATENT DOCUMENTS

| | | | |
|---|---|---|---|
| 1376523 | 9/1964 | France | 5/413 |
| 343081 | 1/1960 | Switzerland | 5/417 |
| 979852 | 1/1965 | United Kingdom | 5/413 |
| 2177292 | 1/1987 | United Kingdom | 5/413 |

*Primary Examiner*—Alexander Grosz
*Attorney, Agent, or Firm*—Patrick J. Walsh

[57] ABSTRACT

A sleeping bag for use outdoors includes a pad of lightweight, soft material such as foam rubber covered with nylon for waterproofing, with an inflatable wedge head and shoulder rest at the head end of the pad extending a substantial distance along the length of the bag and provides support for both the head and shoulders adding to the comfort of the user. The bag is also provided with an outer bag covering substantially the entire covered pad for defining the sleeping bag. Storage pockets form part of the bag at the foot end outside the sleeping bag for receiving personal items. The sleeping bag may be rolled into a compact tube shape, with ends secured by retaining clips, and with an integral shoulder strap for carrying the mat.

4 Claims, 2 Drawing Sheets

SLEEPING BAG WITH INFLATABLE WEDGE PORTION

BACKGROUND OF THE INVENTION

The present invention relates to sleeping bags which may be rolled for carriage after use.

SUMMARY OF THE INVENTION

The present invention comprises a sleeping bag formed of a generally rectangular pad of soft, lightweight material such as foam rubber covered by nylon and fitted with an wedge headrest. The covered pad and headrest define a mat for the sleeping bag. The sleeping bag also includes an inflatable wedge for supporting the head and shoulders with the head end of the wedge rising to a preferred height of one foot and sloping to ground level under the shoulders and upper back for a distance approximately equal to one-third the length of the bed. The covered mat and inflatable wedge are encased in an outer bag and together form the sleeping bag. In a preferred arrangement, the outer bag is equipped with fasteners for attachment to the covered mat. The entire assembly may be rolled for ease of carrying along with a backpack. The covered mat as well as the bed roll are fitted with pockets for storage of personal items.

OBJECTS OF THE INVENTION

It is an object of the invention to provide a sleeping bag.

It is an object of the invention to provide a sleeping bag of a covered mat with a wedge headrest, and an inflatable backrest for elevating the head end of the sleeping bag.

It is a further object of the invention to provide a sleeping bag of covered mat, together with an outer bag preferably fastened to the mat, which can be rolled for carriage with a back pack and so forth.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which.

DETAILED DESCRIPTION OF THE INVENTION

Figure 1:
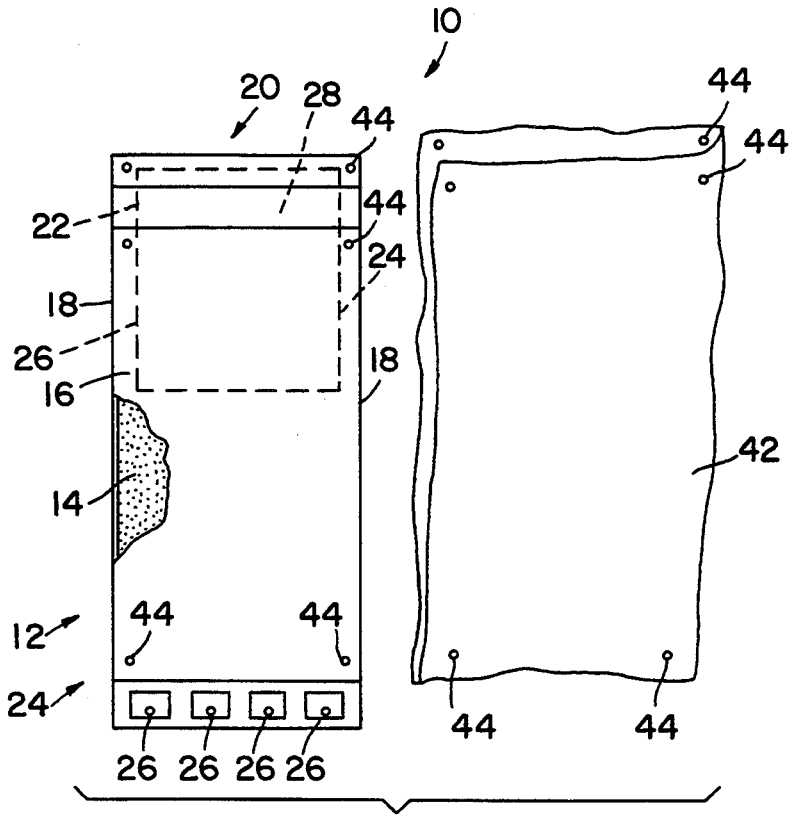
FIG. 1 is a plan view of the sleeping bag including covered mat and outer bag.

Referring now to the drawing, the sleeping bag 10 comprises a covered mat 12 including an interior pad 14 preferably of soft resilient material thin enough to allow easy rolling such as foam rubber together with an exterior water proof covering 16 of a suitable plastic such as nylon. The peripheral edges 18 of the exterior cover are sewn or heat sealed to provide permanent enclosure of the pad. The head end 20 of the bed is provided with a wedge headrest 22 preferable formed of foam rubber and forming an integral part of the pad remaining in place at the head end as the mat is rolled and unrolled for use and carriage. The wedge headrest is also covered by the exterior cover. The exterior covering may be extended a short distance beyond the foot ends 24 of the mat to provide several storage pockets 26 for personal items.

Figure 2:
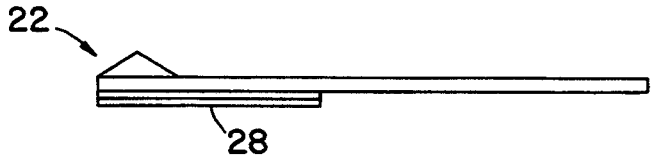
FIG. 2 is a side view of the mat portion of the sleeping bag.
Figure 3:
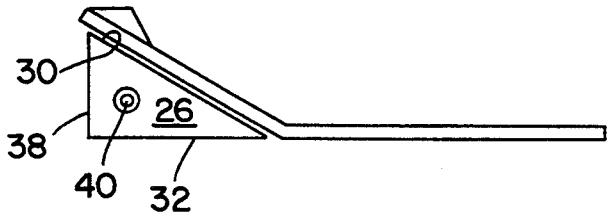
FIG. 3 is a side view of the mat portion of the sleeping bag showing the position of the mat with inflation of the head and upperback support.

The covered mat is also provided with an inflatable wedge or air bag 28 extending approximately one-third of the length and from side to side of the bed to serve as a support for the head and upper back enabling one to be "propped-up" as it were from a prone position. The air bag is constructed of an air tight flexible plastic sheet material and may be secured to the bottom of the exterior mat as shown in FIG. 2 or may be located within the mat between the underside of the pad and the inner surface of the waterproof covering. The inflatable wedge includes inclined top 30, bottom 32, left and right triangular sides, and a rear panel 38. Each air bag panel is of appropriate shape to define the wedge. The rear and left and right side panels fold inward when the wedge is deflated. The air bag is provided with an air filling connection 40 for receiving pressurized air or for being blown up by the user. When inflated, the air bag forms a wedge at the head end surmounted by the headrest for supporting the head and shoulders of the occupant of the sleeping bag.

The sleeping bag includes the covered mat together with an outer bag 42 of suitable waterproof fabric or plastic substantially entirely encasing the covered mat and fitted with means such as snap fasteners 44 for securing the outer bag to the periphery of the mat. In use the occupant reposes on the covered mat within the outer bag.

Figure 4:
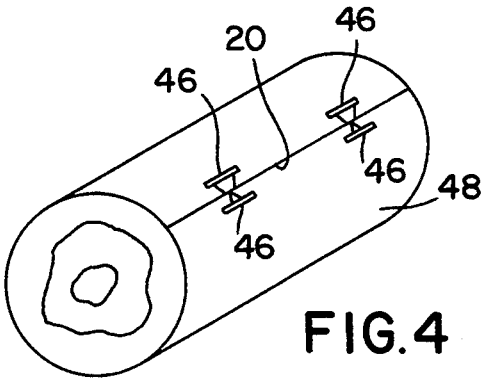
FIG. 4 is a perspective view of the sleeping bag in rolled form.
Figure 5:
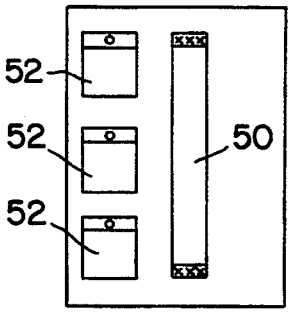
FIG. 5 is a plan view of the sleeping bag rolled illustrating a carrying strap and storage pockets.

After use, the sleeping bag may be rolled into a compact cylinder represented in FIG. 4 with adjoining clip fasteners 46 for holding the bed in rolled form. One set of clips is positioned at the head edge 20 of the covered mat while the mating set are preferably positioned on the bottom surface 48 of the outer bag 42 a distance from the head edge of the bag equal to one-half the circumference of the rolled sleeping bag so that the clips meet and engage each other when the bag is rolled.

The underside 48 of the outer bag is also provided with fittings including a carrying strap 50 and a set of storage pockets 52 for personal items all arranged laterally of the rolled sleeping bag. These fittings are conveniently located on the roll as for example in a position diametrically opposite the fastening clips.

Figure 6:
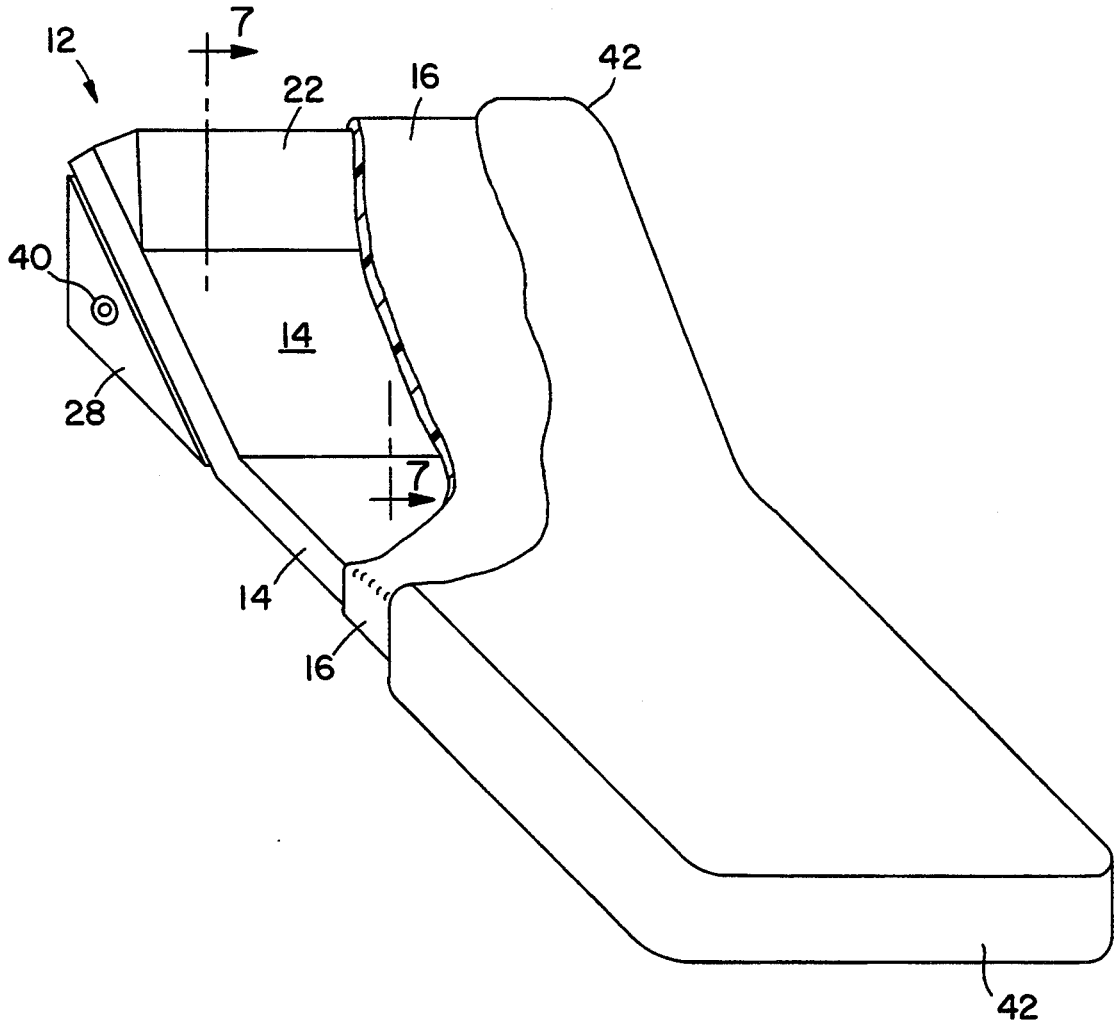
FIG. 6 is an enlarged perspective view partially broken away showing the sleeping bag according to the invention.
Figure 7:
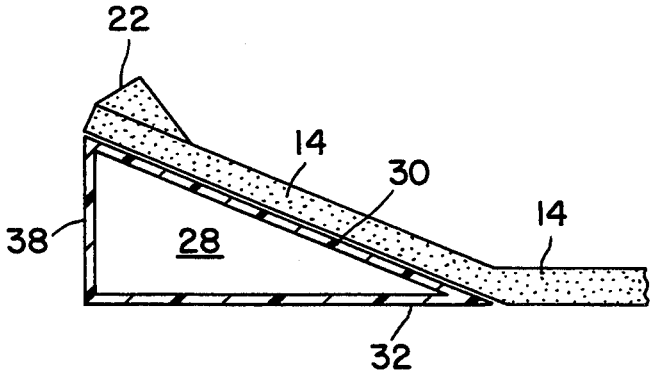
FIG. 7 is a section view taken along line 7—7 of FIG. 6, not showing cover 16 and bag 42.

FIGS. 6 and 7 provide enlarged views of the invention with the outer bag 42 and exterior cover 16 partly broken away (FIG. 6) for illustrating inner components, and with FIG. 7 showing selected inner components in section.

In a preferred embodiment of the invention, the sleeping bag is approximately 30 inches wide and 72 inches long with a headrest 4 inches high and eight inches long, and an inflatable wedge elevation of 12 inches at the head end and inclining along the bag a distance of 30 inches measured horizontally along the bed.

We claim:

1. A sleeping bag comprising an elongate pad (14) of soft material having a head end and a foot end and being sufficiently long and wide to support a reclining adult figure, a wedge-shaped headrest (22) extending across the head end of the pad, an inflatable air bag (28) forming part of the pad extending from the head end approximately one-third the length thereof for supporting the head and shoulders of a reclining figure, means (40) for inflating the air bag into a wedge-shaped support for the head and shoulders of a reclining figure with the wedge sloping from the head end toward the center of the mat and with the headrest (22) superimposed on the inflated wedge (28), a waterproof cover (16) for the pad including headrest and inflatable bag, a storage extension (24) beyond the foot end of the mat having at least one pocket (26) for storing personal items, an outer bag (44) substantially covering the covered pad, headrest, and inflatable bag, securing means including cooperating fasteners (46) affixed the the head edge (20) of the outer bag and to one side (48) of the outer bag for securing the sleeping bag in roll form.

2. A sleeping bag as defined in claim 1 which further comprises a carrying strap attached to the underside of the outer bag.

3. A sleeping bag as defined in claim 1 in which the mat and headrest are fabricated of foam rubber and the cover of nylon, and the outer bag of waterproof material.

4. A sleeping bag as defined in claim 1 in which the air bag is located on the bottom of the pad.

* * * * *